US006279515B1

(12) United States Patent
Coffey et al.

(10) Patent No.: US 6,279,515 B1
(45) Date of Patent: Aug. 28, 2001

(54) COOLANT PUMP CHAMBER COVER WITH IGNITION MODULE SUPPORTS

(75) Inventors: Anthony L. Coffey, Grafton; Robert W. Richards, Sheboygan, both of WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/587,317

(22) Filed: Jun. 5, 2000

(51) Int. Cl.[7] ..... F01P 5/10

(52) U.S. Cl. ..... 123/41.44; 123/41.31; 123/198 E

(58) Field of Search ..... 123/41.44, 41.31, 123/647, 198 E

(56) References Cited

U.S. PATENT DOCUMENTS

| | | | |
|---|---|---|---|
| 3,421,825 | 1/1969 | Maycock | 431/208 |
| 4,951,641 | 8/1990 | Takaishi et al. | 123/647 |

*Primary Examiner*—Tony M. Argenbright
*Assistant Examiner*—Katrina B. Harris
(74) *Attorney, Agent, or Firm*—Quarles & Brady LLP

(57) ABSTRACT

A coolant pump housing for an internal combustion engine includes a cover having integral supports for an ignition module. Each ignition module support projects outwardly to define an elongated member having a mounting end defining a bore sized to receive fasteners for securing an ignition module. Preferably, the coolant pump cover is cast of aluminum. The cover further a pump cavity in fluid communication with inlet and outlet passageways having respective ports for communication of coolant through the coolant pump and the rest of the cooling system.

7 Claims, 2 Drawing Sheets

COOLANT PUMP CHAMBER COVER WITH IGNITION MODULE SUPPORTS

CROSS-REFERENCE TO RELATED APPLICATIONS (Not Applicable.)

STATEMENT REGARDING FEDERALLY SPONSORED RESEARCH OR DEVELOPMENT (Not Applicable.)

FIELD OF THE INVENTION

The field of the invention relates to internal combustion engines, more particularly to a coolant pump housing for use with an internal combustion engine.

DESCRIPTION OF THE BACKGROUND ART

Ignition module supports or posts provide an attachment for mounting an ignition module for starting an internal combustion engine. These ignition module supports are generally elongated members having a relatively small cross-section. Due to this construction the ignition module supports can crack or break off during use. Typically, the supports are cast on the crankcase of the engine so as to be in close proximity to the engine cylinders, which is important to reduce size requirements of the engine and eliminate lengthy electrical system cabling. If one or both supports were to break, the crank case would have to be repaired by welding or replaced entirely. In either case, the labor or replacement part costs are considerable.

BRIEF SUMMARY OF THE INVENTION

The present invention provides an improved coolant pump housing for an internal combustion engine having a pump chamber cover and at least one ignition module support. The pump chamber cover fastens to a pump base to define a pump cavity in fluid communication with inlet and outlet passageways, preferably used to communicate engine coolant through the coolant pump and the rest of the engine cooling system. The ignition module support is integral to, and extends from, the pump chamber cover to a mounting end. The mounting end has a mount for attaching an ignition module.

Although a single support may be sufficient, depending upon the ignition module to be used, it may be preferred to have a pair of ignition module supports. In either case, each ignition module support is preferably an elongated, post-like member extending from a top side of the cover and having a longitudinal bore sized to receive fasteners for mounting an ignition module. Also, the entire cover, including the supports, is preferably cast of aluminum.

An objective and advantage of the present invention is to provide support for ignition modules in an engine configuration in which the coolant pump would otherwise interfere with placement of ignition module supports. This objective is accomplished by casting the ignition module supports into the cover of the coolant pump chamber.

Another object and advantage of the present invention is reduce the repair and replacement cost of cracked or broken ignition module supports. The present invention provides for replacement of the ignition module supports by replacing only the coolant pump cover, rather than repairing or replacing the crankcase.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENT

Figure 1:
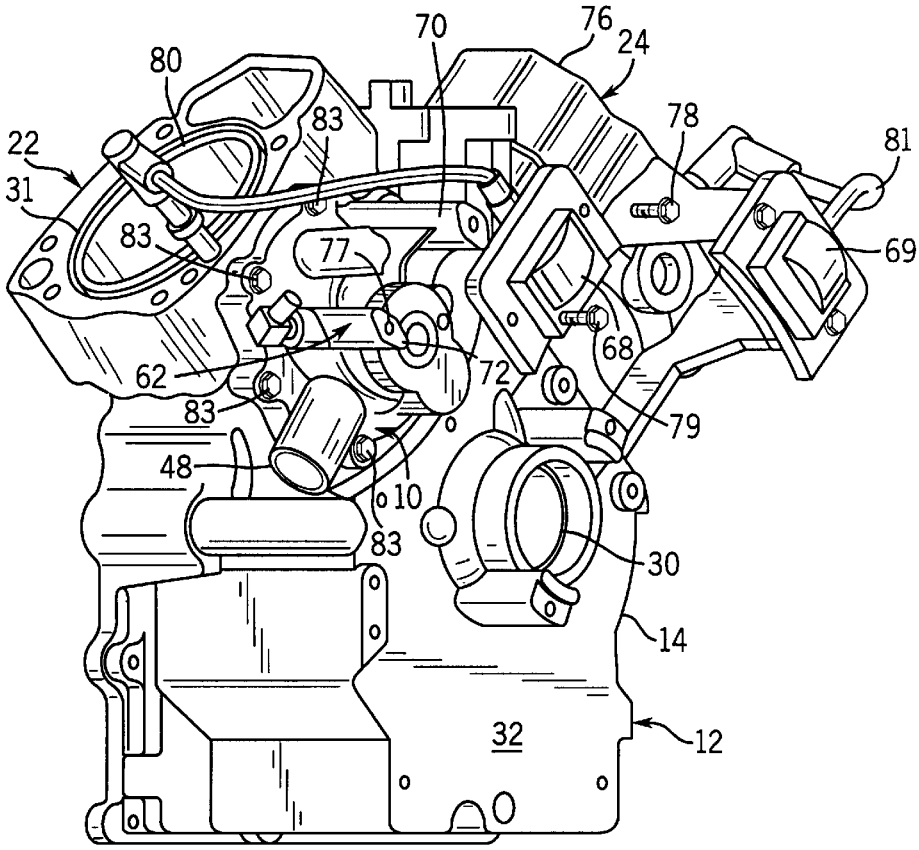
FIG. 1 is a perspective view of a vertical V-type internal combustion engine with which the coolant pump chamber cover of the present invention may be used.

Throughout the figures, the coolant pump chamber cover of the present invention is referred to generally by reference numeral 10. Figure one shows the cover 10 mounted to an internal combustion engine 12 as shown and described in copending application Ser. No. 09/250,856, filed Feb. 17, 1999, and assigned to the assignee of the present invention, which is hereby incorporated by reference as though fully set forth herein. Generally, the engine 12 has a crankcase 14 defining an internal pump chamber (not shown) over which the cover 10 is mounted to enclose an impeller 18 having a plurality of blades 19 fixed to an impeller shaft 20 (see FIG. 4). The crankcase 14 also defines two vertically offset cylinders 22, 24 aligned in a V configuration containing pistons (not shown) controlled by connecting rods driven by a rotating crankshaft (not shown) having an end extending through an opening 30 in a top face 32 of the crankcase 14. A camshaft (not shown) driven by the crankshaft operates the water pump assembly through a belt and sprocket arrangement described in the copending application mentioned above. Coolant, such as water/ethylene glycol or the like, is pressurized by the impeller 18 so that it circulates through the cooling system including through a radiator (not shown) and water jackets 31 surrounding the cylinders 22, 24.

Figure 2:
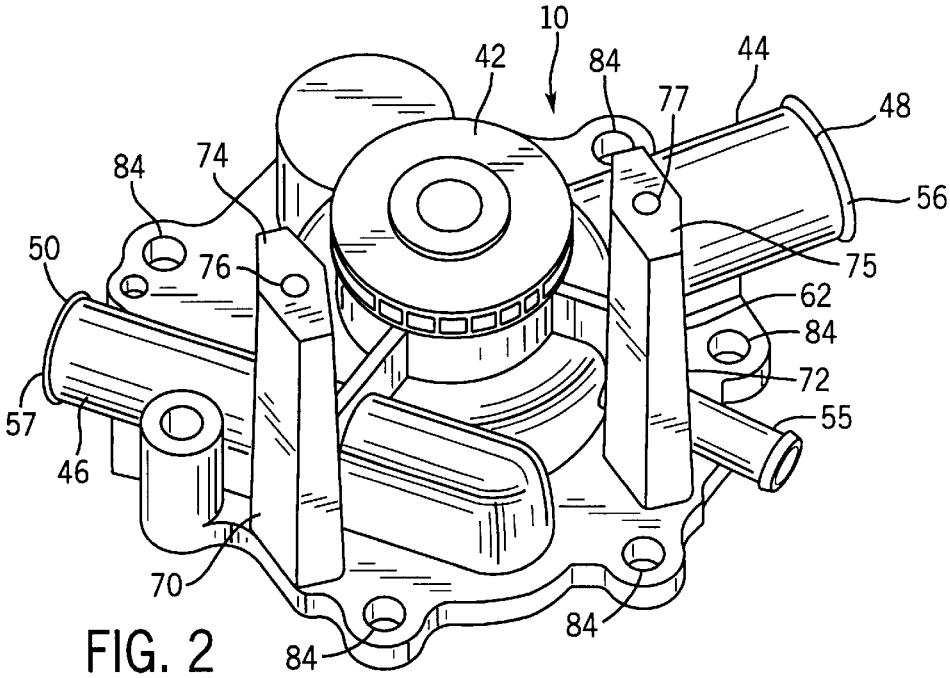
FIG. 2 is a perspective view of the coolant pump chamber cover of FIG. 1 of the present invention having integral ignition module supports.
Figure 3:
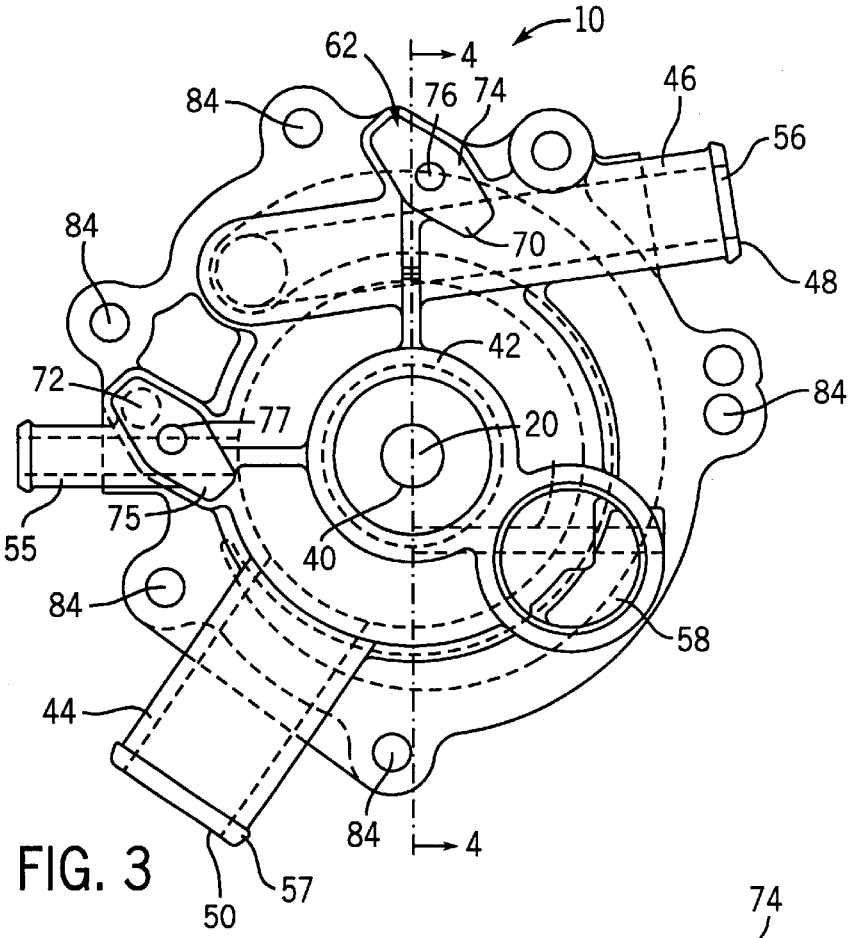
FIG. 3 is a top view of the coolant pump chamber cover of FIG. 2.
Figure 4:
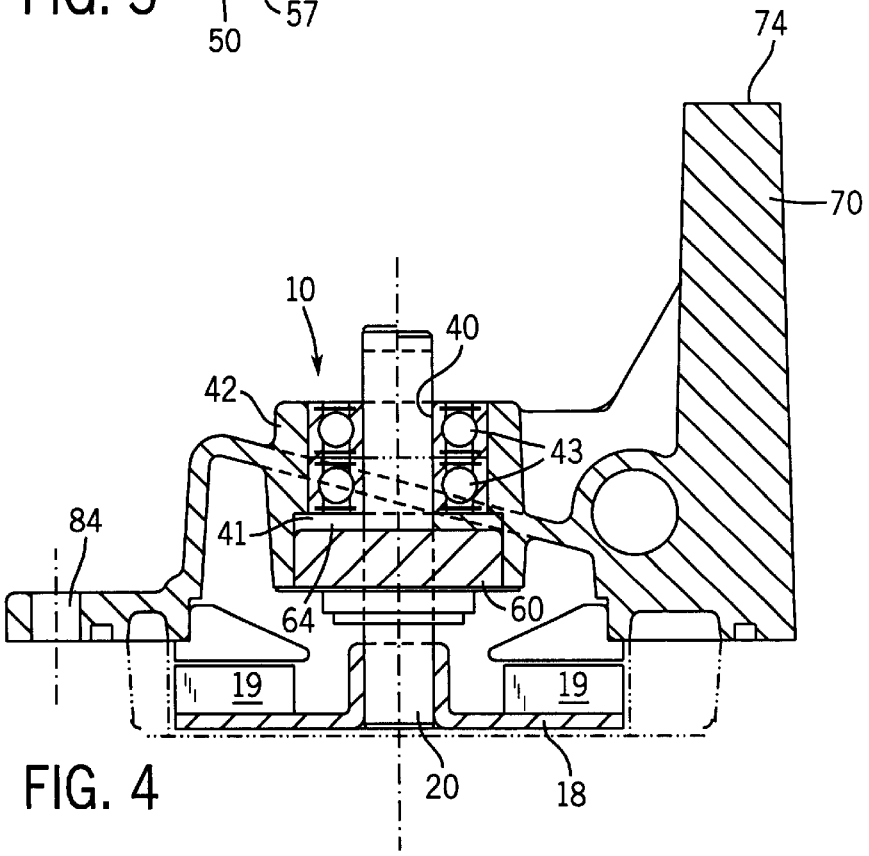
FIG. 4 is a cross-sectional view taken along line 4—4 of FIG. 3

Referring now to FIGS. 2–4, the cover 10 is preferably die cast of aluminum or steel to form an outwardly extending hub 42 sized to fit over a portion of the impeller 18. The hub 42 includes an impeller shaft opening 40 and defines an inner cavity 41 concentric with the shaft opening 40 for receiving shaft bearings 43 in a press-fit. Coolant inlet 44 and outlet 46 passageways are also formed in the cover 10 each having one end in communication with the cavity 41. The passageways 44, 46 are generally cylindrical and have respective ports 48 and 50 allowing circulation of the coolant throughout the cooling system via suitable hoses (not shown). The ports 48, 50 have respective raised rims 56 and 57 for use in securing the hoses. The cover 10 also defines an inlet 55 for bypass flow control. The cover 10 also defines a generally cylindrical coolant leakage reservoir 58 which can retain coolant leaking past an impeller shaft seal 60. The reservoir 58 receives leaking coolant through a passageway (not shown) leading from a space 64 between the seal 60 and the bearings 43. The reservoir 58 has a suitable drain opening for evacuation of the coolant. The cover 10 is secured to the crankcase 14 by fasteners 83 (see FIG. 1) disposed through flange openings 84 along the perimeter of the cover 10.

Referring to FIGS. 1–4, the cover 10 is also formed to include a mount 62 for an engine ignition module 68 (see FIG. 1). Preferably, the mount 62 includes a pair of ignition module supports 70, 72 defining elongated members having flat top surfaces 74 and 75, respectively, on which the ignition module 68 rests and threaded bores 76 and 77, respectively, suitable for receiving respective mounting fasteners 78 and 79 (see FIG. 1). The ignition module supports 70, 72 preferably have a wider base for durability and to inhibit breakage as well as facilitate removal from the die cast. The ignition module supports 70, 72 extend outward, away from the engine when assembled so the ignition module 68 is spaced from the crankcase 14 to allow for easy connection and disconnection.

The ignition module can be any suitable electronic ignition module known in the art. The ignition module 68 provides an electric spark to ignite fuel in cylinder 22 when starting and running the engine 12. A second engine module 69 is removably mounted to the crankcase 14 near cylinder 24 for igniting fuel in cylinder 24. Both ignition modules 68 and 69 are suitably connected to the combustion area of the cylinders 22 and 24 by shaft conductors 80 and 81, respectively (see FIG. 1).

The coolant pump chamber cover 10 of the present invention is particularly useful in compact internal combustion engines, such as the engine 12, as shown in FIG. 1 and described in the above mentioned copending application. Specifically, it allows for a low-profile, recessed pump chamber in the crankcase 14 at a location close to one of the cylinders 22 or 24, which would otherwise interfere with placement of one of the ignition modules 68 or 69. Moreover, with the present invention, broken or cracked ignition module supports 70,72 can be replaced by simply replacing the cover 10. This avoids the material and labor costs of repairing or replacing the much more expensive crankcase.

While there has been shown and described what are at present considered the preferred embodiment of the invention, it will be obvious to those skilled in the art that various changes and modifications can be made therein without departing from the scope of the invention.

We claim:

1. In a coolant pump for an internal combustion engine having a coolant pump base integral with an engine crankcase, the improvement comprising:

a pump chamber cover fastened to the coolant pump base and cooperating therewith to form a pump cavity in fluid communication with an inlet passageway and an outlet passageway;

an ignition module support integrally formed with the pump chamber cover and extending outward therefrom to a mounting end; and a mount formed at the mounting end for attaching an ignition module.

2. The improvement of claim 1, wherein the ignition module support is an elongated member extending from a top side of the pump chamber cover and wherein the mount is a longitudinal bore sized to receive an ignition module mounting fastener.

3. The improvement of claim 2, wherein the ignition module support is larger at the base than at the mounting end.

4. The improvement of claim 1, wherein the pump chamber cover is formed by a casting process.

5. The improvement of claim 4, wherein the pump chamber cover is die cast aluminum.

6. The improvement of claim 1, further having a plurality of the ignition module supports.

7. The improvement of claim 1, wherein the inlet and outlet passageways include inlet and outlet ports.

* * * * *